US009460870B2

(12) United States Patent
Ramirez et al.

(10) Patent No.: US 9,460,870 B2
(45) Date of Patent: Oct. 4, 2016

(54) EXTINGUISHING CHAMBER FOR AN ELECTRIC PROTECTION APPARATUS AND ELECTRIC PROTECTION APPARATUS COMPRISING ONE SUCH CHAMBER

(71) Applicant: Schneider Electric Industries SAS, Rueil-Malmaison (FR)

(72) Inventors: Jean-Claude Ramirez, Saint Martin D'Uriage (FR); Herve Vallier, Monestier de Clermont (FR); Benoit Hage, Saint Jean de Moirans (FR); Loic Rondot, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/296,659

(22) Filed: Jun. 5, 2014

(65) Prior Publication Data

US 2015/0053648 A1 Feb. 26, 2015

(30) Foreign Application Priority Data

Jun. 26, 2013 (FR) ..... 13 56107

(51) Int. Cl.
*H01H 9/34* (2006.01)
*H01H 71/02* (2006.01)

(52) U.S. Cl.
CPC ..... *H01H 9/342* (2013.01); *H01H 71/025* (2013.01)

(58) Field of Classification Search
CPC ..... H01H 9/047; H01H 9/342; H01H 71/02; H01H 33/62; H01H 73/18
USPC ..... 218/34, 35, 41, 51, 139, 149, 157; 335/133, 201, 202; 361/521
See application file for complete search history.

(56) References Cited

U.S. PATENT DOCUMENTS 3,506,799 A * 4/1970 Ellsworth et al. ..... 218/22
4,511,772 A * 4/1985 Link et al. ..... 218/149
(Continued)

FOREIGN PATENT DOCUMENTS

DE 10 2008 021 138 A1 10/2008
DE WO2011064091 * 6/2011 ..... H01H 9/342
(Continued)

OTHER PUBLICATIONS

Machine translation of DE102008021138 (orig. doc . published Oct. 30, 2008).*
(Continued)

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

An arc extinguishing chamber includes an arc formation chamber containing a stationary contact and a movable contact which form an arc between them when separated. The arc formation chamber communicates with an inlet of a second chamber. A separating wall is placed in a volume downstream from said second chamber. The wall extends in the direction of the gas flow to partition the volume in the direction of the flow of the gases and exhaust outlets enabling the quenching gases to be removed outside of the apparatus. The separating wall(s) extend(s) in such a way as to partition in the direction of the flow to the outlets and to thereby form at least a first removal duct and a second removal duct, said ducts each being associated with an exhaust outlet and enabling a substantially complete separation to be achieved between a first flow and a second flow.

12 Claims, 5 Drawing Sheets

(56) References Cited

U.S. PATENT DOCUMENTS

| | | | | |
|---|---|---|---|---|
| 4,639,564 | A | 1/1987 | Grunert et al. | |
| 5,153,545 | A * | 10/1992 | Ferullo et al. | 335/201 |
| 6,614,334 | B1 * | 9/2003 | Gibson et al. | 335/202 |
| 2005/0219021 | A1 * | 10/2005 | Fleege | H01H 9/342 335/201 |
| 2012/0298627 | A1 * | 11/2012 | Maloney | 218/157 |

FOREIGN PATENT DOCUMENTS

| | | | | |
|---|---|---|---|---|
| EP | 0 201 731 | A2 | 11/1986 | |
| FR | 2 511 188 | A1 | 2/1983 | |
| FR | 2 575 861 | A1 | 7/1986 | |
| GB | 2 273 609 | | 6/1994 | |
| JP | 2002352692 | * | 12/2002 | H01H 9/342 |
| WO | WO 02/075760 | A1 | 9/2002 | |

OTHER PUBLICATIONS

Machine translation of WO02075760 (orig. doc. published Sep. 26, 2002).*

Machine Translation of WO2011064091 (orig. doc. published Jun. 3, 2011).*

Translation JP2002352692 (Org. doc. published Dec. 6, 2002).*

French Preliminary Search Report issued Mar. 17, 2014 in French Application 13 56107, filed on Jun. 26, 2013 ( with English Translation of categories of Cited Documents).

* cited by examiner

EXTINGUISHING CHAMBER FOR AN ELECTRIC PROTECTION APPARATUS AND ELECTRIC PROTECTION APPARATUS COMPRISING ONE SUCH CHAMBER

BACKGROUND OF THE INVENTION

The present invention relates to electric protection apparatuses designed to perform interruption of the electric current by separation of the contacts so as to protect equipment and persons from the effects of short-circuit currents, and more particularly to the field of protective circuit breakers of ultra terminal type.

The invention relates more particularly to the exhaust volume located downstream from the arc extinguishing chamber of such an apparatus.

This arc extinguishing chamber comprises an arc formation chamber containing a stationary contact and a movable contact which, at the moment they separate, form an arc between them, said arc formation chamber communicating with the inlet of a second chamber called arc extinguishing chamber, at least one separating wall placed in a volume situated downstream from said arc extinguishing chamber, said wall extending in the direction of the gas flow so as to perform partitioning of the above-mentioned volume in the direction of this flow of the gases, and at least one exhaust outlet enabling the quenching gases to be removed to the outside of the apparatus.

STATE OF THE PRIOR ART

In a manner known as such, as soon as the contacts separate following the occurrence of a short-circuit in an electric circuit, an electric arc occurs between the contacts, which arc will establish an arcing voltage.

The arc then moves towards an arc extinguishing chamber comprising in usual manner separators designed to cool the gases, after which the gases due to the arc exit from the arc extinguishing chamber and pass through slits arranged in a bottom grate downstream from the separators.

These gases are then collected in a volume which is situated under the arc extinguishing chamber.

This volume can be formed by one or more channels designed to enable flow of the gases to the outlet openings provided in the case of the apparatus via which these gases escape to the outside.

Patents WO 02/075760 and FR 2575861 are for example known describing an arc extinguishing chamber equipped with a wall performing partitioning of the above-mentioned volume in the direction of the gas flow.

Patent FR 2575861 further describes the use of chicanes downstream from the arc extinguishing chamber, the object of the latter being to slow down the gas flows.

These known architectures of the exhaust area do not give complete satisfaction. Gas plugs do in fact form at the outlet of the arc extinguishing chamber, which plugs are due to a conflicting interaction between the flows taking place between the separators. The gas flows in fact exit from the arc extinguishing chamber in a perpendicular direction to the direction which they have to follow to be displaced to the exhaust outlets located at the end of the gas collection volume.

This problem linked to flow of the gases can cause partial melting of the above-mentioned bottom grate. This problem is all the greater the smaller the pitch of the circuit breaker, this reduction of the circuit breaker pitch resulting in a reduction of the gas collection volume.

SUMMARY OF THE INVENTION

The present invention solves these problems and proposes an arc extinguishing chamber for an electric protection apparatus which is of simple design, enabling these gas plugs to be eliminated so as to increase and stabilise the voltage of the short-circuit arc, in particular in the pre-chamber, thereby enabling a faster and cleaner break to be obtained, as well as proposing an electric protection apparatus comprising one such chamber.

For this purpose, the object of the present invention is to provide an arc extinguishing chamber for an electric protection apparatus of the above-mentioned kind, said chamber being characterized in that the above-mentioned separating wall(s) extend(s) in such a way as to form a substantially complete partitioning in the direction of the flow to these openings and to thereby form at least a first removal duct and a second removal duct, said ducts each being associated with an exhaust outlet, and enabling a substantially complete separation to be achieved between a first flow called main flow and a second flow called secondary flow, said flows being emitted at the outlet of the arc extinguishing chamber and respectively flowing in the first and second ducts.

Due to this total separation of the gas flows, the main flow is prevented from having a negative influence on the secondary flow.

According to a particular feature, the exhaust outlets and the arc extinguishing chamber are arranged with respect to one another in such a way that the gas flows exit from the arc extinguishing chamber in a substantially perpendicular direction to the direction in which the gas flows exit from the apparatus via the exhaust outlets.

By means of this separation of the gas flows, in this particular embodiment of the arc extinguishing chamber, formation of gas plugs at the outlet of the arc extinguishing chamber due to the conflicts liable to occur between the flows between the separators is prevented.

According to another feature, the above-mentioned exhaust outlets are situated on the rear panel of the apparatus designed for fixing of the latter on a fixing support.

According to another feature, the electric protection apparatus comprising an electromagnetic protection device and the arc extinguishing device being situated between this electromagnetic protection device and the fixing panel of the apparatus on a fixing support, the first flow called main flow is emitted on the side where the fixing support is located, whereas the second flow called secondary flow is emitted on the side where the electromagnetic protection device is located.

On account of this structure of the apparatus, the main flow takes place on the side where the fixing support is located, for example a fixing rail, whereas the secondary flow takes place on the side where the electromagnetic protection device is located and is weaker.

According to another feature, the cross-section of the above-mentioned ducts decreases progressively as the exhaust outlets are approached.

According to another feature, this arc extinguishing chamber comprises an insulating bottom grate placed downstream from the arc extinguishing chamber and comprising openings designed to enable passage of the gases generated when quenching is performed.

Dissociation of the flows improves the crossover effects of the gases between the different outlet openings of the bottom grate of the chamber.

According to another feature, this chamber further comprises means for balancing the lengths of the paths of the gas flows in the two ducts. The length of the path of the main flow is therefore closer to that of the path of the secondary flow. This feature enables the arc to enter in a perpendicular direction to the axis of alignment of the separators of the arc extinguishing chamber.

According to another feature, these means comprise means for separating the gas flows in the direction of the thickness of the apparatus. Engineering this partitioning in three dimensions thereby enables a suitable length of these ducts to be had in spite of the asymmetric architecture of these ducts due to the location of the exhaust apertures on the fixing surface of the apparatus.

According to another feature, the above-mentioned separating means in the direction of the thickness of the apparatus comprise two partitions substantially perpendicular to one another and forming a step, said step being arranged in the duct called first duct so as to form a salient volume in this duct, and at the same time to increase the length of the path of the gas flow in this duct, and on the other hand to form a recessed volume in the duct called second duct, the gas flow flowing in the first duct above this step whereas the gas flow flows in the second duct underneath this step.

According to another feature, the exhaust outlet associated with the second duct is situated underneath the above-mentioned step, whereas the exhaust outlet associated with the first duct is located at the foot of the step.

According to another feature, the above-mentioned exhaust outlets are located at the same height, the latter being defined in a parallel direction to the rear panel of the apparatus and perpendicularly to the longitudinal direction of the fixing support.

According to a particular feature, the above-mentioned ducts are moulded together with the enclosure of the apparatus.

According to another embodiment, the above-mentioned ducts are housed in a modular cassette.

It is a further object of the present invention to provide an electric protection apparatus comprising an arc extinguishing chamber comprising the above-mentioned features taken either alone or in combination.

According to a particular feature, this apparatus is a low-voltage circuit breaker.

BRIEF DESCRIPTION OF THE DRAWINGS

But other advantages and features of the invention will become more clearly apparent from the following description which refers to the appended drawings given for example purposes only and in which.

DETAILED DESCRIPTION OF A PREFERRED EMBODIMENT OF THE INVENTION

Figure 1:
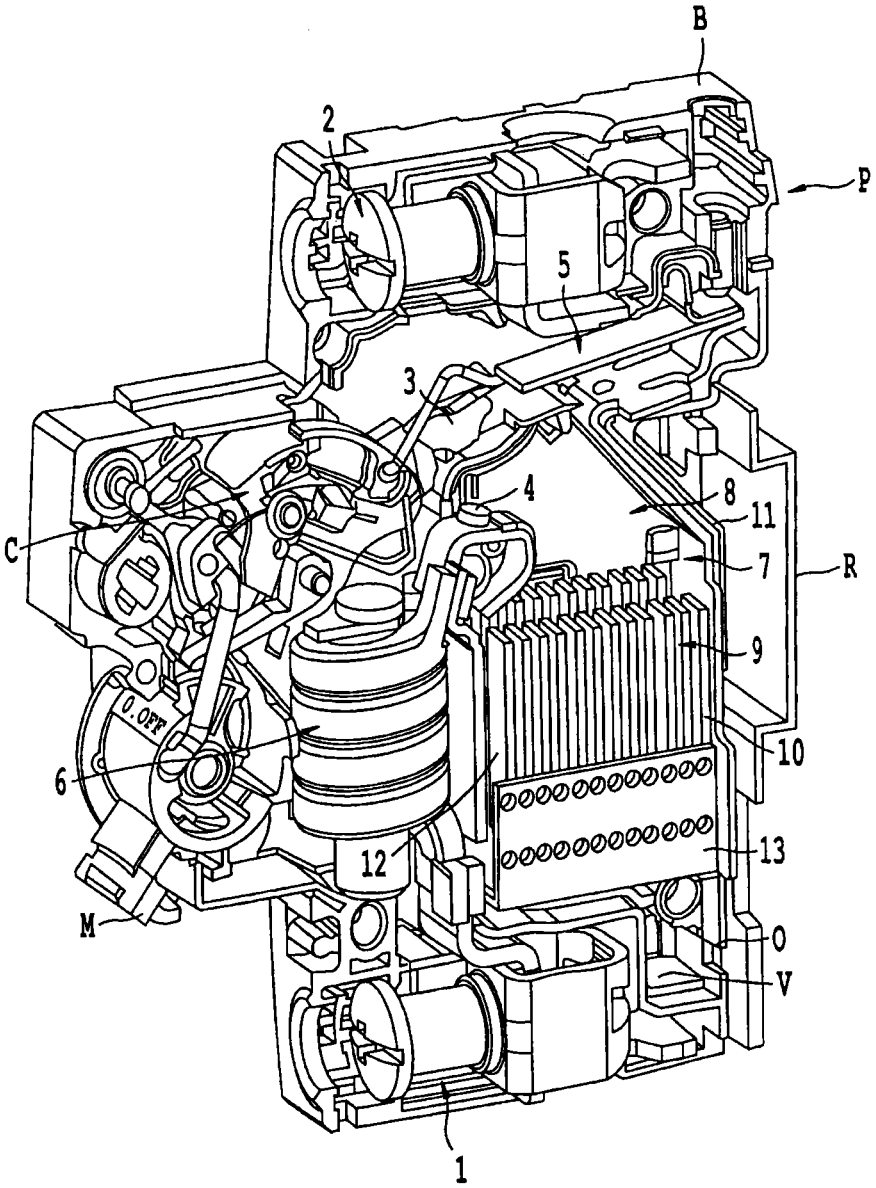
FIG. 1 is a plane view of a circuit breaker according to the prior art illustrating the innards of the apparatus.

A pole p of a miniature circuit breaker comprising an insulating case B having an operating handle M on its front panel and connection terminals 1,2 on its two narrow side panels, can be seen in FIG. 1. A movable contact 3 and a stationary contact 4 are housed inside the case, in a manner known as such.

The movable contact 3 is commanded by an operating mechanism C connecting the above-mentioned handle M to the movable contact for performing closing or opening of the contacts.

A thermal trip release 5 and an electromagnetic trip release 6 designed to cause automatic opening of the contacts 3,4 in the event of an overload or a short-circuit, are also housed in this case.

The bottom part of the case B contains an arc extinguishing chamber 7 formed by a first chamber called arc formation chamber 8 communicating with the inlet of a second chamber 9, called arc extinguishing chamber, the latter comprising fins 10. The movable contact 3 extends substantially perpendicularly to the plane in which the plates extend so as to draw an arc between the contacts when separation of the latter takes place, the initial direction of which is substantially parallel to the plates.

The above-mentioned arc extinguishing chamber 7 is laterally delineated by arcing horns 11,12 respectively electrically connected to the above-mentioned two terminals. These arcing horns are arranged so as to pick up the arc drawn between the contacts when separation of the latter takes place.

This circuit breaker comprises a volume v for removal of the quenching gases, downstream from the arc extinguishing chamber, and on outlet of this volume, exhaust outlets o for removing the gases to the outside of the apparatus.

Such a circuit breaker being well known to those specialised in the art, describing its arrangement or operation in greater detail will serve no useful purpose.

The arc extinguishing chamber 9 of the circuit breaker advantageously in known manner comprises, in its downstream part, a grate 13 made from plastic material, which can be moulded with the case or the cover of the apparatus, but which can also be independent. The function of this grate is to prevent the arc from re-forming behind the fins downstream from the arc extinguishing chamber.

Figure 2:
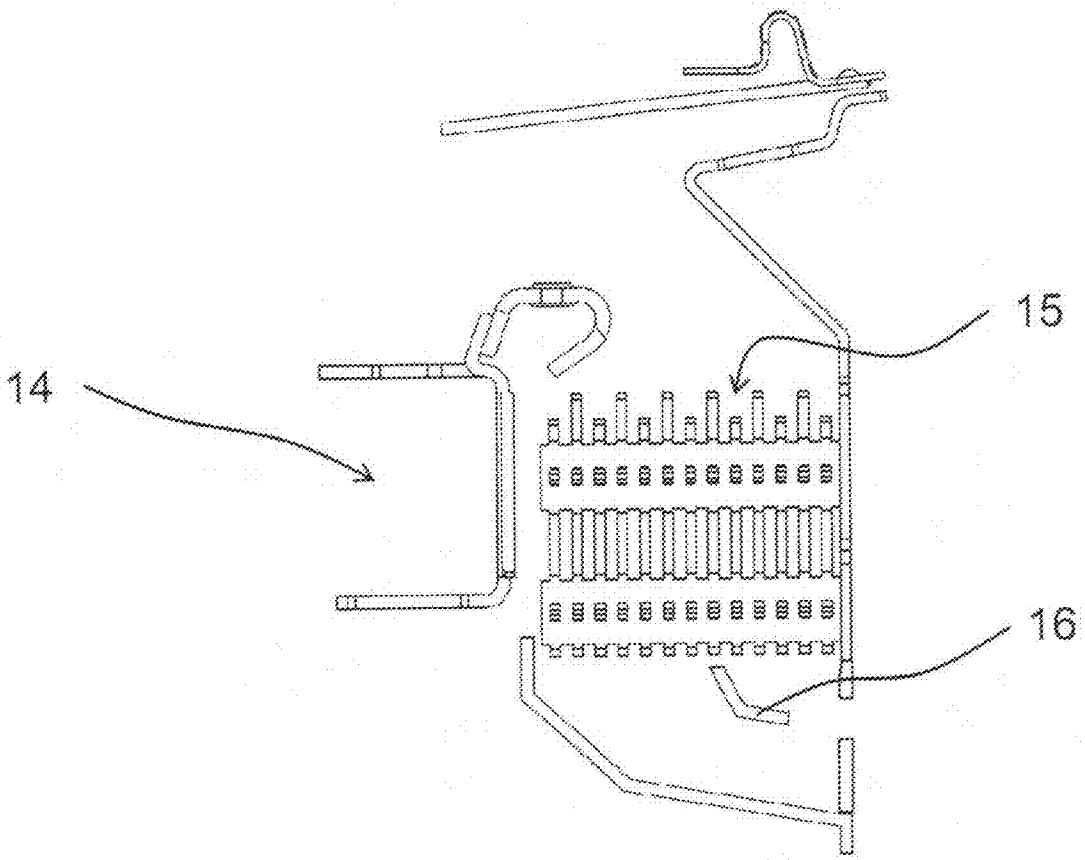
FIG. 2 is a partial plane view of the previous figure illustrating the arc extinguishing chamber alone.

In FIG. 2, an arc extinguishing chamber 14 according to the prior art has been represented comprising, downstream from the arc extinguishing chamber 15, a partition 16 for separating the gas flow in the direction of the flow.

Figures 3, 3A, 3B:
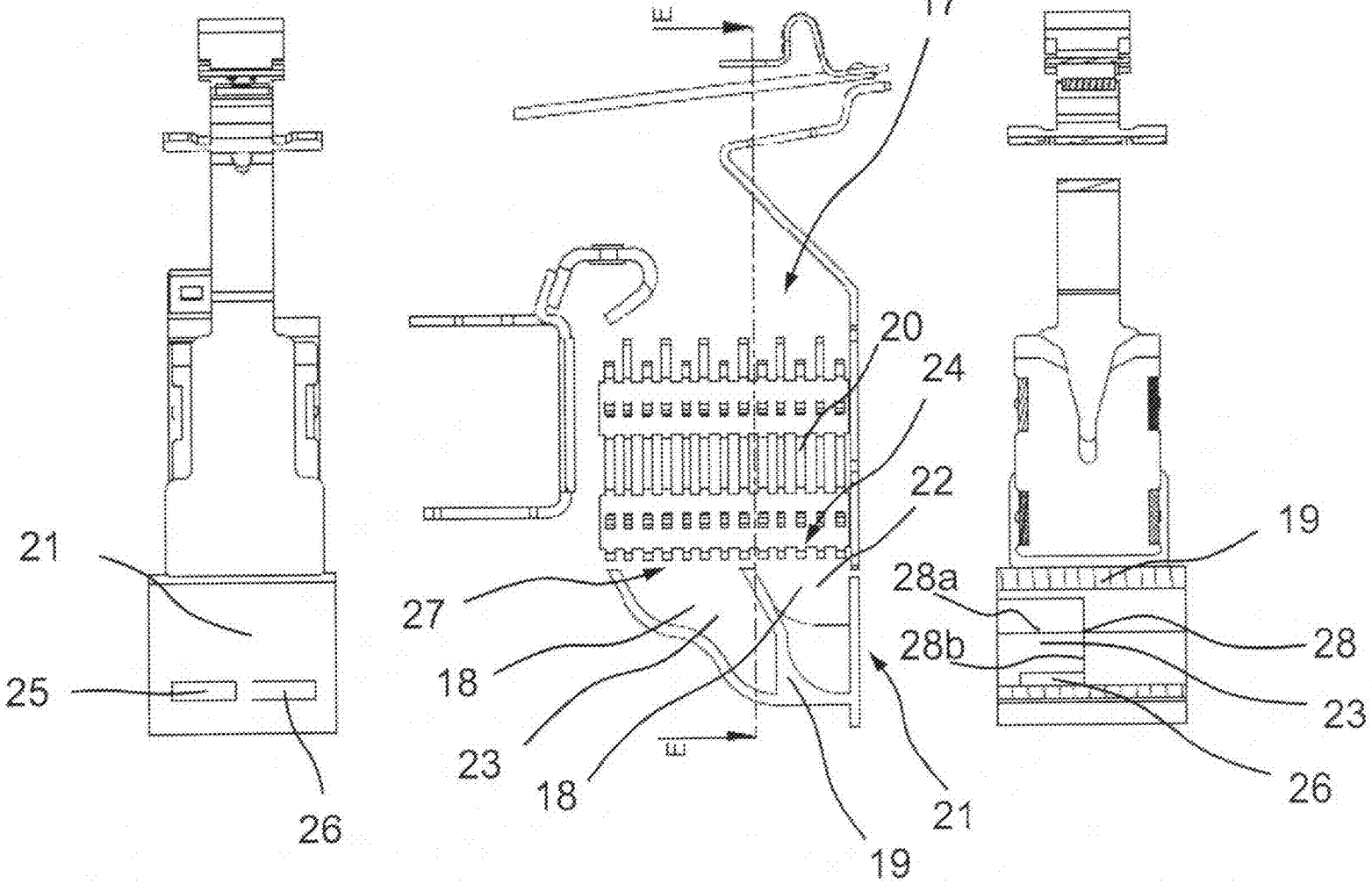
FIG. 3 is a similar view to the previous figure, but illustrating an arc extinguishing chamber according to a particular embodiment of the invention.
FIG. 3*a* is a cross-sectional view along the line m-m of FIG. 3.
FIG. 3*b* is a left-hand side view of FIG. 3, FIGS. 4 and 4*a* are perspective views respectively with two different orientations, illustrating the arc extinguishing chamber according to the particular embodiment illustrated in FIGS. 3,3*a* and 3*b*.
Figure 4A:
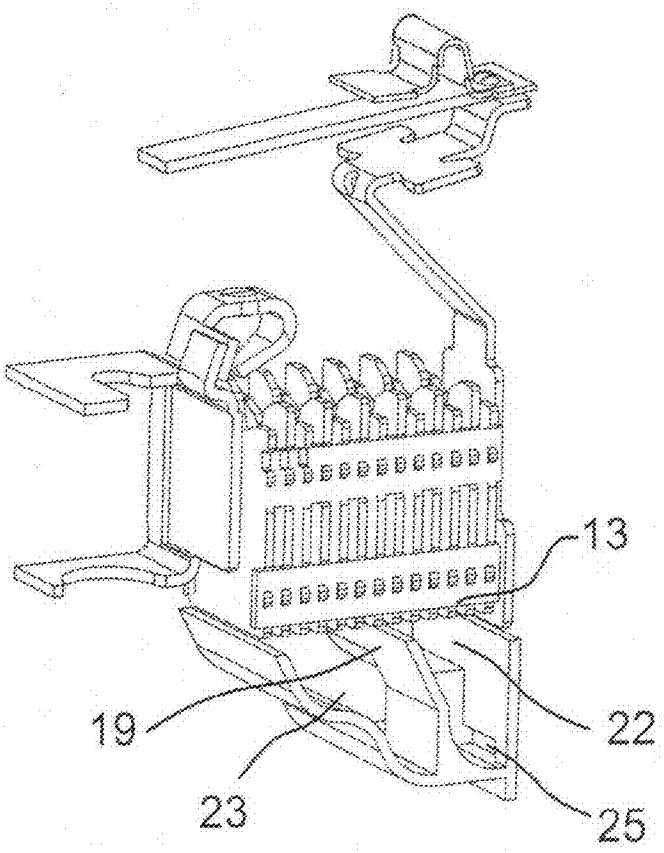
Figure 4:
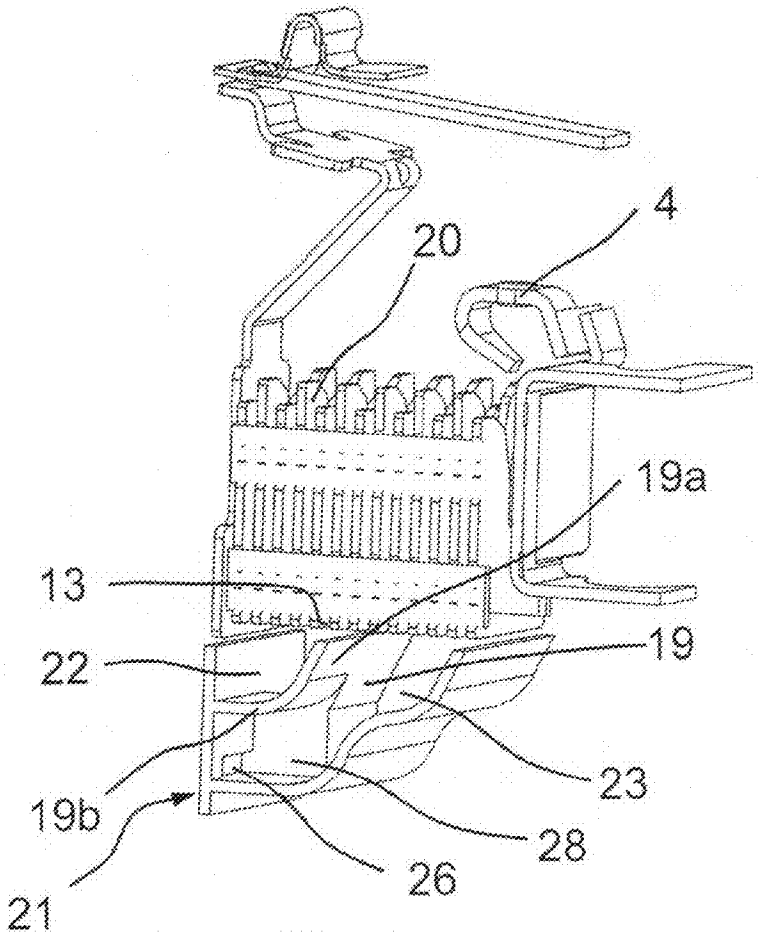

In FIGS. 3 to 4*a*, an arc extinguishing chamber 17 according to a preferred embodiment of the invention can be seen in which the gas flow collection volume 18 is partitioned on the one hand in the direction of the gas flow and on the other hand in the direction of the thickness of the apparatus.

Partitioning in the direction of the gas flow is performed by a separating wall 19 starting from the separators 20, in a position situated between a quarter and three quarters of the length of the set of separators then, after a curve, extending up to the plane of the rear panel 21, or fixing panel, of the apparatus. This separating wall 19 is thus formed by two portions 19*a*,19*b* extending forming an angle comprised between 90° and 160° with respect to one another, one extending in a plane substantially parallel to the plane of the fins 20, whereas the other extends in a plane extending substantially perpendicularly to the fixing panel 21 of the apparatus. It can be noted that the angle between the two partitions will vary according to the position of this partition. This partition 19 thus forms two gas flow exhaust ducts 22,23, respectively a first duct 22 located facing the fins 24 situated in the immediate proximity of the exhaust outlets 25,26 for removal of the gases to the outside, and a second duct 23 situated facing the fins 27 located away from these outlets, each duct 22,23 being associated with an exhaust outlet 25,26.

This partitioning in the direction of the thickness of the apparatus is achieved by means of a step 28 formed salient inside the first duct 22 and recessed inside the second duct 28, this step formed by two walls 28*a*,28*b* substantially perpendicular to one another creating an additional volume of substantially rectangular shape in the first duct 22 and at the same time decreasing the volume of the second duct 23 by this same volume. It should be noted that other shapes than the rectangular shape can be envisaged for this wall.

This partitioning in the direction of the thickness of the apparatus enables the two above-mentioned removal ducts 22,23 to be formed respectively associated with two exhaust outlets 25,26 for removal of the gases to the outside, the latter being situated at the same height, this height being defined perpendicularly to the longitudinal direction of the fixing rail.

It should be noted that these exhaust openings or outlets can be of different positions, size and shapes, for example one above the other, one next to the other, or in staggered manner according to the position of the latch and to the shape of the partitions. Furthermore, as explained in the foregoing, these openings can open out elsewhere than at the rear of the circuit breaker.

Thus, in operation, due to the dissociation of the gas flows performed by the partitioning in the direction of the flows, which partitioning is performed over the whole of the path taken by the gases, the gas flows located farthest from the exhaust outlets 25,26 are collected separately from those emitted in proximity to the gas outlet openings, said openings being located on the same side as the fixing rail R.

This dissociation of the gas flows enhances the flows limiting the crossover effects of the gases between the different exhaust outlets of the bottom grate 13 of the chamber. By limiting these crossover effects, disturbances of the gas flow liable to create the previously mentioned plugs are also limited.

This partitioning in the direction of the thickness of the apparatus enables the gas collection volume v to be rearranged by a redistribution of the volume used by the second duct 23. This rearrangement further enables the length of the path taken by the gases in the first duct to be lengthened, which enables the gases to be emitted at a lower temperature than is usually the case in apparatuses according to the prior art.

This rearrangement of the gas collection volume v also enables a progressive reduction of the cross-section of the exhaust ducts to be obtained in the two ducts 22,23 as the exhaust outlet is progressively approached in order to take account of the decrease of the temperature and therefore of the volume of the gases.

Providing this partitioning in the three dimensions thus makes it possible to have a suitable length of these ducts in spite of the asymmetric architecture of the exhaust ducts due to the location of the exhaust outlets on the fixing panel 21 of the apparatuses.

These arrangements can advantageously be engineered when moulding of the circuit breaker enclosures is performed.

This quenching gas collection volume v can also be provided in a modular cassette in the form of a cassette dissociated from the enclosures. One of the advantages of this provision of the gas collection volume in a dissociated cassette is to be able to adjust the different compartments according to the stresses related to flow of the gases and to provide a certain flexibility as far as the material composing this cassette is concerned, independently from the apparatus.

This solution further presents the advantage of being able to optimize specialized cassettes for a particular type of product according to its performance (high breaking capacity, low breaking capacity), its cost, the fact that it is associated with a Vigi or not, etc. . . .

Figure 5:
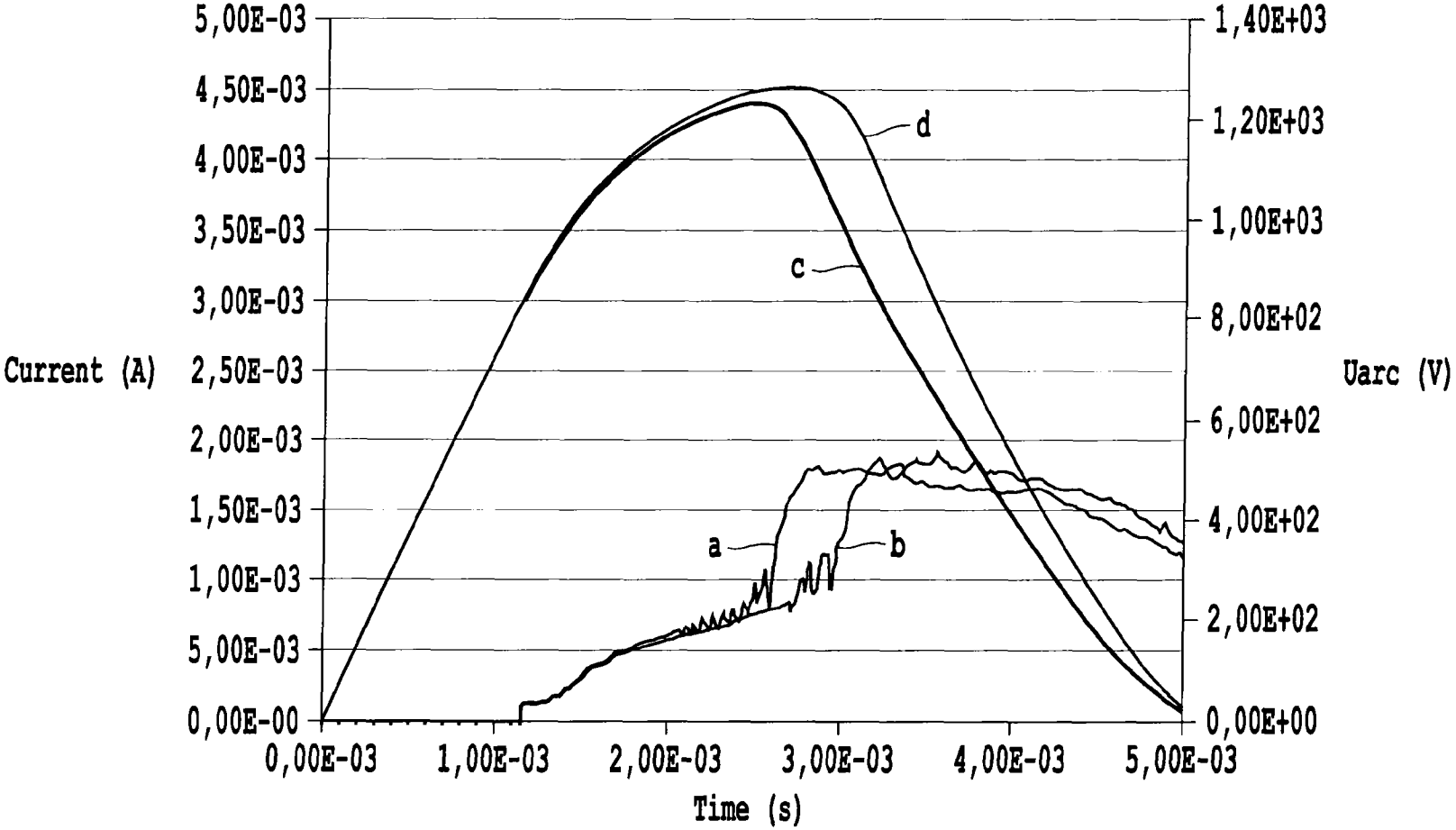
FIG. 5 is a graphic representation illustrating the arcing current and voltage versus time in an arc extinguishing chamber according to the prior art and in an arc extinguishing chamber according to the invention.

Referring now to FIG. 5, the breaking behaviour of an apparatus according to the prior art can be compared with that of an apparatus according to the invention performing separation of the flows at 6 kA.

The graphic representation of FIG. 5 illustrates the current in amps (left-hand scale) and the arcing voltage (right-hand scale) versus time in seconds. It can be observed that in the case of an apparatus according to the invention, the arcing voltage increase (curve plot a) is performed 400 μs more quickly than in the case of an apparatus according to the prior art (curve plot b). A better current limiting is thus obtained in an arc extinguishing chamber according to the invention (curve plot c) compared with that obtained in the arc extinguishing chamber according to the prior art (curve plot d).

It can be noted that this dissociation of the gas flows can be achieved by means of one or more flux separating partitions, this partition or these partitions being arranged in such a way that partitioning is performed all the way to the exhaust outlets so as to obtain this dissociation. This separation of the gas flows enables a good cooling of the gases to be obtained before they are ejected from the product.

An arc extinguishing chamber and an electric protection apparatus comprising one such chamber have thus been achieved according to the invention, wherein the gas flows are dissociated so as to eliminate the influence of one of the flows on the other of the flows, and furthermore wherein the main gas flow is disturbed so as to place it at a disadvantage compared with the secondary flow, thereby fostering a homogenous arc insertion.

As the invention thus achieves elimination of gas plugs which at present arise even at the level of the mechanism of the apparatus, this enables the short-circuit arcing voltage to be increased and stabilized, in particular in the pre-chamber. This also enables a faster and cleaner break to be obtained providing enhanced protection of equipment and persons.

The invention also enables the gas flow at the outlet of the chamber to be better controlled, thereby enabling the breaking residues to be better eliminated to outside the chamber thereby rendering the product more rugged.

The invention also enables maintaining and positioning of the chamber to be ensured, enables a different material from that of the cases to be chosen in case of the choice of using a cassette, this possibility being more difficult in the case of partitions moulded directly in the enclosures.

The invention is naturally in no way limited to the embodiments described and illustrated herein that have been given for example purposes only.

Thus for example the number of separating partitions can be increased so as to further increase the dissociation of the gas flows.

Likewise, the main claim also covers the case where the exhaust outlets are lateral to the ducts formed by the partitioning wall and close to the rear panel of the apparatus. These outlets can thus be directed upwards, downwards, or laterally. Likewise, these outlets can open into the terminal compartment or into the differential protection device, etc. . . .

On the contrary, the invention extends to encompass all the technical equivalents of the described means as well as combinations thereof if the latter are achieved according to the spirit of the invention.

The invention claimed is:

1. An arc extinguishing chamber for an electric protection apparatus comprising:

an arc formation chamber containing a stationary contact and a movable contact which, at a moment the stationary contact and the movable contact separate from each other, form an arc between the stationary contact and the movable contact, said arc formation chamber communicating with an inlet of a second chamber, at least one separating wall placed in a volume situated downstream from said second chamber, said at least one separating wall extending in a direction of the gas flows so as to perform partitioning of the volume in the direction of the gas flows and at least one exhaust outlet quenching gases to be removed to the outside of the electric protection apparatus; and two partitions substantially perpendicular to one another and forming a step, said step being arranged in a first removal duct so as to form a salient volume in the first removal duct and at the same time to increase a length of a path of the gas flows in the first removal duct, and to form a recessed volume in a second removal duct, the gas flows flowing in the first removal duct above the step whereas the gas flows flow in the second removal duct underneath the step, wherein the at least one separating wall extends in such a way as to form a substantially complete partitioning in the direction of the gas flows to the at least one exhaust outlet and to thereby form at least the first removal duct and the second removal duct, said ducts each being associated with the at least one exhaust outlet and achieving a substantially complete separation between a first flow of the gas flows and a second flow of the gas flows, said first and second flows being emitted at the at least one exhaust outlet of the arc extinguishing chamber and respectively flowing in the first removal duct and second removal duct, the at least one exhaust outlet and the arc extinguishing chamber being arranged with respect to one another in such a way that the gas flows exit from the arc extinguishing chamber in a substantially perpendicular direction to the direction in which the gas flows exit from the electric protection apparatus via the at least one exhaust outlet, and wherein a cross-section of each removal duct decreases continuously from an exhaust duct opening to the at least one exhaust outlet.

2. The arc extinguishing chamber according to claim 1, wherein the at least one exhaust outlet is situated on a rear panel of the electric protection apparatus designed for fixing the electric protection apparatus on a fixing support.

3. The arc extinguishing chamber according to claim 1, wherein the electric protection apparatus further comprises an electromagnetic protection device and the arc extinguishing device being situated between this electromagnetic protection device and a fixing panel of the electric protection apparatus on a fixing support, the first flow is emitted on a side where the fixing support is located whereas the second flow is emitted on a side where the electromagnetic protection device is located.

4. The arc extinguishing chamber according to claim 3, wherein the exhaust outlets are located at the same height, the latter being defined in a parallel direction to a rear panel of the electric protection apparatus and perpendicularly to the longitudinal direction of the fixing support.

5. The arc extinguishing chamber according to claim 1, further comprising an insulating bottom grate placed downstream from the arc extinguishing chamber and comprising openings designed to enable passage of the gases generated when quenching is performed.

6. The arc extinguishing chamber according to claim 1, further comprising means for balancing lengths of paths of the gas flows in the first and second removal ducts.

7. The arc extinguishing chamber according to claim 6, wherein the means for balancing further comprise means for separating the gas flows in a direction of a thickness of the electric protection apparatus.

8. The arc extinguishing chamber according to claim 1, wherein the at least one exhaust outlet associated with the second removal duct is situated underneath the step, whereas the at least one exhaust outlet associated with the first removal duct is located at a foot of the step.

9. The arc extinguishing chamber according to claim 1, wherein the first and second removal ducts are molded together with an enclosure of the electric protection apparatus.

10. The arc extinguishing chamber according to claim 1, wherein the first and second removal ducts are housed in a modular cassette.

11. An electric protection apparatus comprising the arc extinguishing chamber according to claim 1.

12. The electric protection apparatus according to claim 11, wherein the electric protection apparatus is a low-voltage circuit breaker.

* * * * *